United States Patent [19]

Shibuya

[11] Patent Number: 4,544,331

[45] Date of Patent: Oct. 1, 1985

[54] SWASH-PLATE TYPE COMPRESSOR

[75] Inventor: Tsunenori Shibuya, Konan, Japan

[73] Assignee: Diesel Kiki Co., Ltd., Tokyo, Japan

[21] Appl. No.: 450,081

[22] Filed: Dec. 15, 1982

Related U.S. Application Data

[63] Continuation-in-part of Ser. No. 160,597, Jun. 18, 1980, abandoned.

[30] Foreign Application Priority Data

Jun. 29, 1979 [JP] Japan ..... 54-82391

[51] Int. Cl.[4] ..... F04B 1/16; F01M 9/00

[52] U.S. Cl. ..... 417/269; 184/6.17

[58] Field of Search ..... 417/269; 184/6.17

[56] References Cited

U.S. PATENT DOCUMENTS

| | | | |
|---|---|---|---|
| 3,801,227 | 4/1974 | Nakayama . | |
| 3,838,942 | 10/1974 | Pokorny | 417/269 |
| 3,904,320 | 9/1975 | Kishi . | |
| 4,127,363 | 11/1978 | Kato et al. . | |
| 4,135,862 | 1/1979 | Degawa . | |
| 4,229,145 | 10/1980 | Isizuka . | |
| 4,260,337 | 4/1981 | Nomura | 417/269 |
| 4,289,453 | 9/1981 | Shibuya . | |
| 4,321,019 | 3/1982 | Degawa . | |
| 4,326,838 | 4/1982 | Kawashima | 417/269 |

*Primary Examiner*—William L. Freeh

*Attorney, Agent, or Firm*—Frishauf, Holtz, Goodman & Woodward

[57] ABSTRACT

A pair of combined cylinder blocks which are horizontally disposed are formed with wall portions extending from the boss portions of the cylinder blocks to the bottoms thereof. The wall portions define therebetween a swash plate chamber and an oil pan located beneath the swash plate chamber. The wall portions are each formed with a lubricating oil channel communicating the oil pan with a through bore formed in the cylinder block through which the drive shaft of the compressor extends. Due to a pressure differential between the swash plate chamber and the suction chambers of the pump, lubricating oil in the oil pan is led through the lubricating oil channels and gaps between the drive shaft and the through bores and supplied to radial bearings supporting the drive shaft in the through bores, thrust bearings supporting the swash plate and the sliding portions between the swash plate and the pistons to lubricate same. Further, the ends of the lubricating oil channels opening in the through bores are located at such axial predetermined locations as ensure suitable distribution of lubricating oil to the radial bearings and the thrust bearings.

6 Claims, 4 Drawing Figures

SWASH-PLATE TYPE COMPRESSOR

This application is a continuation-in-part application of application Ser. No. 160,597, filed June 18, 1980 now abandoned.

BACKGROUND OF THE INVENTION

The present invention relates to a swash-plate type compressor for use in air conditioners for vehicles or the like, and more particularly to lubrication of the bearing portions supporting the drive shaft as well as the sliding portions between the swash plate and the pistons.

As known, e.g., from U.S. Pat. No. 3,801,227, a conventional compressor of this kind is typically constructed such that a pair of cylinder blocks are combined together in axial alignment and horizontally disposed. The cylinder blocks each include an axial through bore extending along the axis thereof, through which bore a drive shaft extends. A swash plate is secured on the drive shaft. Each one pair of valve plates and cylinder heads are mounted on the outer ends of the combined cylinder blocks. The cylinder blocks further include a plurality of cylinder bores axially extending therethrough, in each of which a piston is slidably received. The cylinder bore, the piston and the valve plate deline in cooperation a pumping chamber therebetween. The swash plate has its outer fringe disposed in engagement with the pistons in such a manner that rotation of the drive shaft causes the pistons to make reciprocating motions within the cylinder bores by means of the swash plate, for pumping action. The drive shaft is supported in the radial directions by radial bearings mounted within the through bores and in the axial directions by thrust bearings arranged at opposite sides of the swash plate.

With this arrangement, lubrication of the radial bearings, the thrust bearings and the sliding portions between the swash plate and the pistons is carried out due to a pressure differential produced in the compressor. More specifically, an oil reservoir is provided beneath the swash plate chamber between the cylinder blocks. Lubricating oil stored in the oil reservoir is splashed into a mist by the swash plate being rotated in unison with rotation of the drive shaft, and the misty oil is supplied to the thrust bearings arranged at the opposite sides of the swash plate and the sliding portions between the swash plate and the pistons. Simultaneously, due to a pressure differential between the swash plate chamber and the radial bearing sections which is caused by the reciprocating motions of the pistons within the cylinder bore which are in communication with the swash plate chamber, part of the misty oil fed to the thrust bearings is delivered to the radial bearings through gaps between the drive shaft and the axial through bores.

However, according to the above-mentioned pressure differential lubrication, due to the supply of lubricating oil in the form of a mist to various sliding portions in the compressor an inadequate amount of lubricating oil is supplied to these portions, causing insufficient lubrication of same. Further, the supply of lubricating oil to the sliding portions depends upon the concentration of the lubricating oil used, so that stable lubrication may not be obtained.

OBJECTS OF THE INVENTION

It is therefore the object of the invention to provide a swash-plate type compressor which employs a differential pressure type lubrication system in which lubricating oil in the oil reservoir is supplied in the form of a liquid, instead of a mist, to various sliding portions in the compressor through lubricating oil channels communicating the oil reservoir with the drive shaft-fitted through bores.

It is another object of the invention to provide a swash-plate type compressor which has lubricating oil channels communicating with the reservoir open at ends in the shaftfitted through bores at such predetermined axial locations as permit supply of suitable amounts of lubricating oil to both the radial bearings and the thrust bearings.

The above and other objects, features and advantages of the invention will be more apparent from the following description taken in connection with the accompanying drawings.

DETAILED DESCRIPTION

Figure 1:
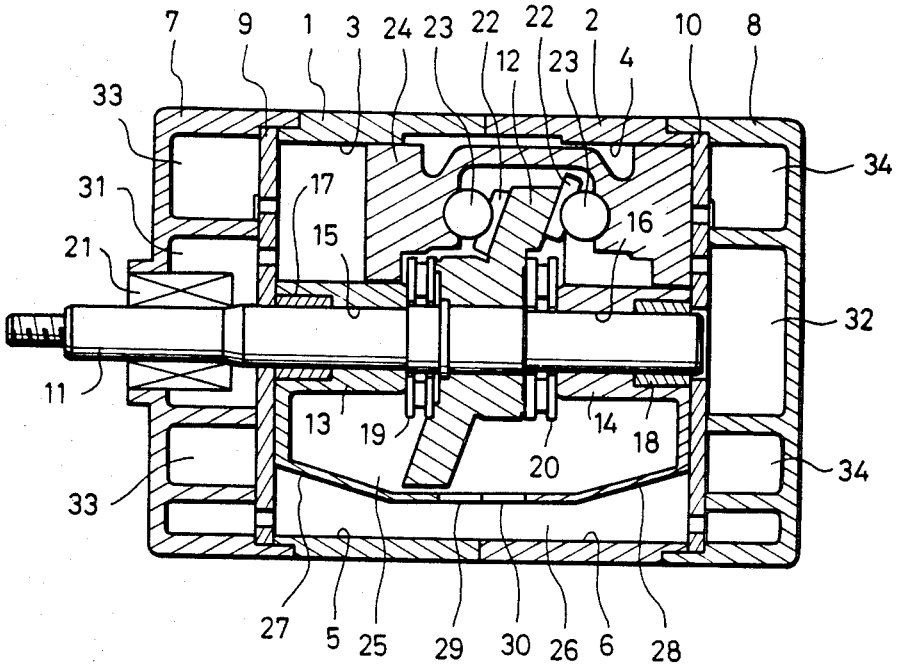
FIG.1 PRIOR ART
FIG. 1 is a longitudinal sectional view of a conventional swash-plate type compressor.

Referring now to the drawings wherein like reference characters designate like or corresponding parts throughout the views, FIG. 1 illustrates a conventional swash-plate type compressor. A pair of cylinder blocks 1, 2 are combined together in axial alignment with their axes horizontally disposed. These combined cylinder blocks 1, 2 are formed therein with a plurality of cylinder bores 3, 4 extending along the axes of the cylinder blocks and a plurality of through bores interposed between adjacent cylinder bores 3, 4 (each one of the cylinder bores and the through bores 5, 6 is shown in FIG. 1). Secured to the outer ends of the combined cylinder blocks 7, 8 are cylinder heads 7, 8 with valve plates 9, 10 intervenining between the cylinder blocks 1, 2 and the cylinder heads 7, 8. The cylinder heads, the cylinder blocks and the valve plates are connected together in an airtight manner.

A drive shaft 11 extends through the cylinder blocks 1, 2 axially thereof, on which a swash plate 12 is rigidly fitted. The drive shaft 11 further extends outwardly of the compressor through the front cylinder head 7 via a sealing member 21 fitted in the same head. The cylinder blocks 1, 2 have boss portions 13, 14 formed therein with through bores 15, 16 in which the drive shaft 11 is inserted. Radial bearings 17, 18 which are formed of plain bearings, are arranged within the through bores 15, 16 for supporting the drive shaft 11 in the radial directions, while thrust bearings 19, 20, which are formed of needle bearings, are mounted between the boss portions 13, 14 and the swash plate 12 at opposite ends of the latter, for supporting the swash plate 12 in the axial directions.

The swash plate 12 has its outer fringe disposed in engagement with double acting pistons 24 via shoes 22 and balls 23, which pistons are slidably received within the cylinder bores 3, 4 of the opposed cylinder blocks 1, 2.

Reference numeral 25 designates a swash plate chamber formed between the opposed cylinder blocks 1, 2 in communication with all the cylinder bores 3, 4. Located beneath the swash plate chamber 25 is an oil pan 26 formed within a lowermost one of the through bores 5. The swash plate chamber 25 and the oil pan 26 are separated from each other by partition walls 27, 28 horizontally extending from opposed inner end walls of the cylincer blocks 1, 2 but communicate with each other via through holes 29, 30 formed in the partition walls 27, 28.

The cylinder heads 7, 8 are formed therein with suction chambers 31, 32 communicating with a refrigerant inlet port, not shown, and delivery chambers 33, 34 arranged around the suction chambers 31, 32 and communicating with a discharge port, not shown.

The swash-plate type comprssor with the abovedescribed construction operates such that rotation of the drive shaft 11 causes corresponding reciprocating motions of the pistons 24 within the respective cylinder bores 3, 4 so that refrigerant in the suction chambers 31, 32 is introduced into the cylinder bores 3, 4 through the valve plates 9, 10, compressed by the pistons and then discharged into the delivery chambers 33, 34 via the valve plates 9, 10, to be delivered into a refrigerating circuit, not shown, through the discharge port. During this compressing operation, part of the refrigerant in the pumping chambers defined within the cylinder bores 3, 4 is leaked, as a blow-bye gas, through the clearances between the pistons 24 and the cylinder bores 3, 4 and flows into the swash plate chamber 25 so that the pressure within the chamber 25 becomes higher than that within the suction chambers 31, 32. Consequently, lubricating oil in the form of a mist present in the swash plate chamber 25 is forced to pass through the thrust bearings 19, 20 and the gaps between the boss portion 13, 14 of the cylinder blocks 1, 2 and the drive shaft 11 to the radial bearings 17, 18 and further travels through the same bearings into the suction chambers 31, 32 via valve plates 9, 10. Thus, the radial bearings and thrust bearings are both lubricated. On the other hand, lubricating oil at the bottom of the swash plate chamber 25 is splashed into a misty oil by the rotation of the swash plate 12 and fed to the sliding portions between the swash plate 12 and the pistons 24.

As previously mentioned, the above-mentioned pressure differential type lubrication system has drawbacks, i.e., insufficient and unstable lubrication, inherent in the arrangement that lubricating oil is supplied in a misty state to the sliding portions of the compressor.

Figure 4:
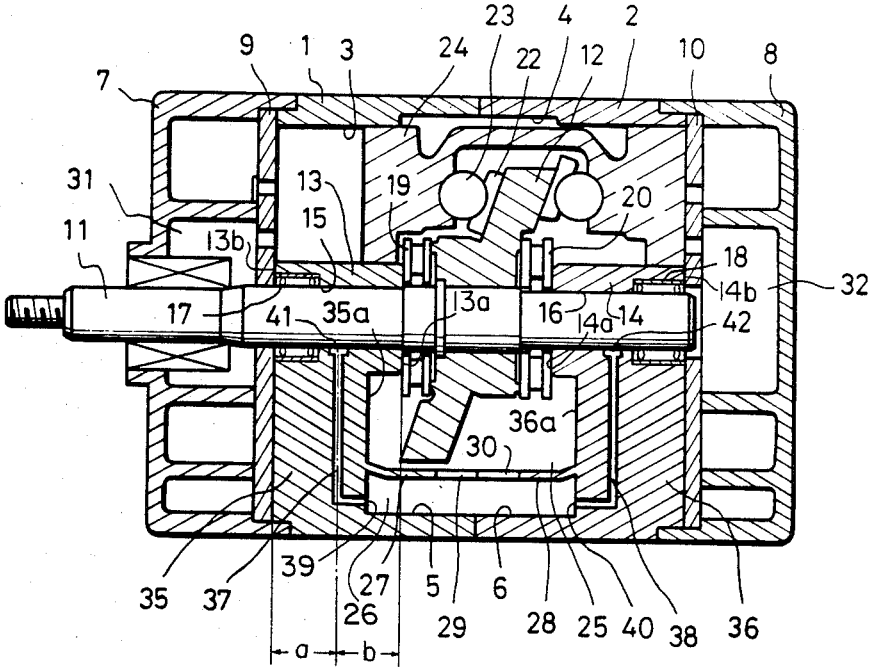
FIG. 4 is a longitudinal sectional view of a swash-plate type compressor according to another embodiment of the invention.
Figure 2:
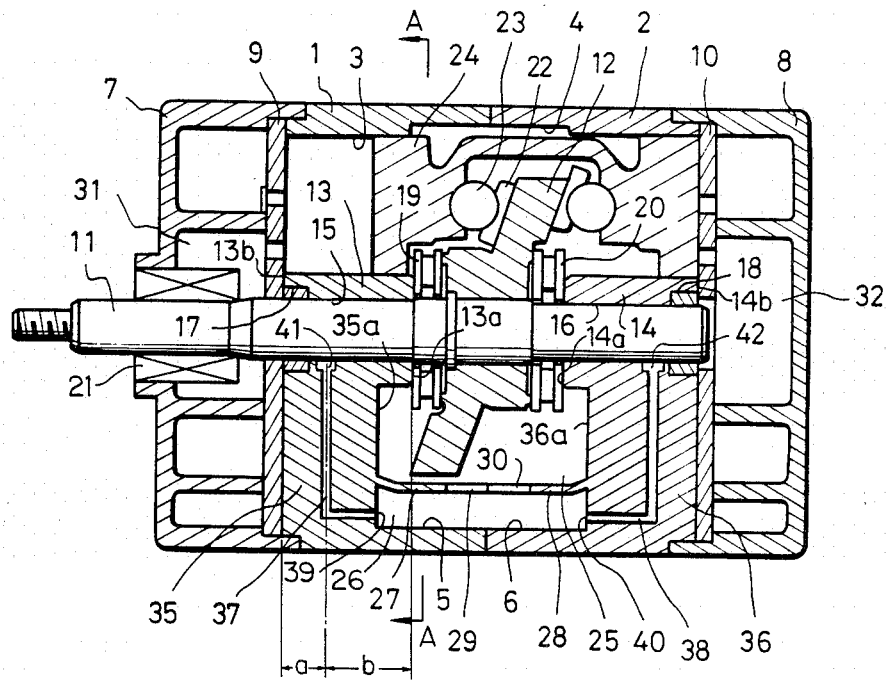
FIG. 2 is a longitudinal sectional view of a swash-plate type compressor according to one embodiment of the invention.
Figure 3:
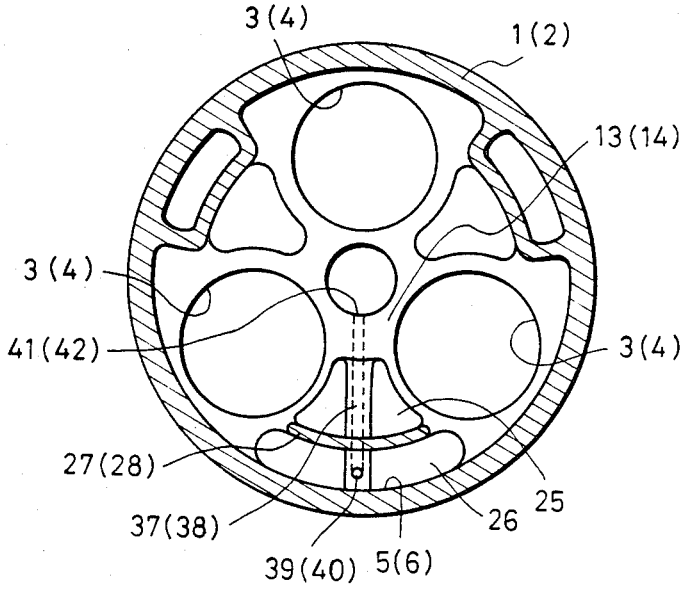
FIG. 3 is a sectional view taken along line A—A in FIG. 2, showing only a cylinder block used in the compressor.

FIGS. 2 through 4 illustrate a swash-plate type compressor according to embodiments of the present invention. As clearly shown in FIG. 3, cylinder blocks 1, 2 which are combined together are formed therein with a plurality of cylinder bores 3, 4 in a manner similar to the previously mentioned conventional compressor. Defined between lower ones of the cylinder bores 3, 4 is a swash plate chamber 25 which has its lower portion bordered by an oil pan 26 by means of partition walls 27, 28. More specifically, the cylinder blocks 1, 2 are formed integrally with wall portions 35, 36 with large thickness which extend downward from the respective boss portions 13, 14 of the cylinder blocks 1, 2 formed therein with through bores 15, 16 in which the drive shaft 11 is inserted, and reaches the bottom of the cylinder blocks 1, 2. The wall portions 35, 36 each have one end face located flush with an outer end face of the associated cylinder block 1, 2 and the other end face, which forms a vertical wall surface 35*a*, 36*a*, located between the radial bearing 17, 18 and the thrust bearing 19, 20 within the through bore 15, 16. The boss portions 13, 14 of the cylinder blocks 1, 2 have inner end faces 13*a*, 14*a* disposed opposite and spaced from each other, and outer end faces 13*b*, 14*b* disposed in contact with the valve plates 9, 10 via suction valves, not shown. The partition walls 27, 28 formed with through holes 29, 30, respectively, extend from the respective opposed vertical end surfaces 35*a*, 36*a* of the wall portions 35, 36 and joined together at their ends to define the swash plate 25 at a higher location in the space between the wall portions 35, 36 and the oil pan 26 at a lower location in the same space.

The wall portions 35, 36 are each formed therein with a lubricating oil channel 37, 38 (with a diameter of the order of 3–4 mm), one end 39, 40 of which opens in a lower portion of the oil pan 26 and the other end 41, 42 opens in the through bore 15, 16 within the boss portion 13, 14 at a location between a radial bearing 17, 18 formed of a plain bearing within the through bore 15, 16 and a thrust bearing 19, 20 formed of a needle bearing, located between the boss portions 13 14, and the swash plate 12.

In FIG. 3 in which the radial bearings 17, 18 are formed of plain bearings, the open ends 41, 42 of the lubricating oil channels 37, 38 are each located in the respective through bores 15, 16 at locations where the ratio of a distance a to a distance b is 1 to 2 or a smaller ratio, provided that a represents the distance between the diametrical center of the open end 41, 42 of the lubricating oil channel 37, 38 and an outer end face 13*b*, 14*b* of the boss portions 13, 14 disposed in contact with the valve plate 9, 10 via a suction valve, not shown, and b the distance between the diametrical center of the open end 41, 42 and the inner end face 13*a*, 14*a* of the boss portion 13, 14 disposed in contact with the outer race of the thrust bearing 19, 20. If the radial bearings 17, 18 are formed of needle bearings as shown in FIG. 4, the open ends 41, 42 of the lubricating oil channels 37, 38 are located at locations where the above ratio of a to b is approximately 1 to 1.

The reason for locating the open ends 41, 42 so as to satisfy the above distance ratios is as follows: In a conventional swash-plate type compressor, as previously stated, the thrust bearings 19, 20 are lubricated to some sufficient extent by lubricating oil in the oil reservoir 26 splashed by the rotating swash plate 12, whereas the radial bearings 17, 18 are lubricated by very small amounts of lubricating oil fed thereto through the gaps between the through bores 15, 16 and the drive shaft 11 from the thrust bearing sections due to pressure difference. To sufficiently lubricated the radial bearings 17, 18, lubricating oil should desirably be supplied to them at a rate at least about one and half times as large as the oil amount fed to the thrust bearings 19, 20, through the lubricating oil channels 37, 38. To satisfy this oil feeding requirement, the locations of the open ends 41, 42 of the lubricating oil channels 37, 38 should be determined by taking into consideration the pressures in the suction chambers 31, 32 and in the swash plate chamber 25 at locations in the vicinity of the inner end faces 13*a*, 14*a* of the boss portions 13, 14 of the cylinder blocks 1, 2, as well as the flow resistance acting upon the lubricating oil fed through the gaps between the through bores 15, 16 and the drive shaft 11 and the same flow resistance through the radial bearings 17, 18. To be concrete, when the drive shaft 11 rotating at a speed of 2000 rpm, the pressure in the suction chambers 31, 32 has a value of about 2 kg/cm$^2$ substantially the same with the refrigerant suction pressure, the pressure in the oil pan 26 about 2.5 kg/cm$^2$, and the pressure in the swash plate chamber 25 near the boss portion inner end faces 13*a*, 14*a* about 2.45 kg/cm$^2$ which is a little lower than the oil pan pressure due to centrifugal force produced by rotation of the thrust bearings 19, 20, respectively. The latter pressures are a little higher than the suction chamber pressure due to generation of blow-bye gas. Therefore, lubricating oil delivered through the lubricating oil channels 37, 38 to their open ends 41, 42 are apt to be fed to the suction chambers 31, 32, that is, the radial bearings 17, 18 in larger quantities than the thrust bearings 19, 20. On the other hand, the total flow resistance through the gaps between the through bores 15, 16 and the drive shaft 11 at zones between the open ends 41, 42 of the lubricating oil channels 37, 38 and the outer end faces 13*b*, 14*b* of the boss portions 13, 14 of the cylinder blocks 1, 2 is larger when plain bearings are provided in the gaps than when neither such bearings nor bearing-fitting recesses are provided in the gaps. Incidentally, the clearance of the above gaps is generally set at a value of 0.02–0.04 mm in compressors employing the pressure differential type lubricating system. In view of the above circumstances, according to the invention, the open ends 41, 42 of the lubricating oil channels 37, 38 are located so as to satisfy that the ratio of the distance a to the distance b is 1 to 2 or a smaller ratio in the case of plain bearings are provided as radial bearings in the gaps. By so locating the open ends 41, 42, lubricating oil can be fed to the radial bearings 17, 18 at a rate larger by at least about 1.5 times than to the thrust bearings 19, 20. Further, sufficient lubricating oil fed to the radial bearings 17, 18 is partly fed to the sealing member 21 for the drive shaft 11 in the front suction chamber 31 to lubricate same sufficiently.

If needle bearings are provided as radial bearings in the gaps between the drive shaft 11 and the through bores 15, 16, which has smaller resistance than plain bearings, the ratio between the distance a and the distance b is set at 1:1, in view of the fact that the pressure in the suction chambers 31, 32 is lower than the pressure in the swash plate chamber 25 in the vicinity of the inner end faces 13*a*, 14*a* of the cylinder block boss portions 13,14, to thereby achieve the above-mentioned object of feeding lubricating oil to the radial bearings 17, 18 at a rate larger by at least about 1.5 times than to the thrust bearings 19, 20.

Further, the ends 41, 42 of the lubricating oil channels 37, 38 each have an opening with a larger diameter than that of the remainder for facilitating feeding of lubricating oil to the radial bearing and the thrust bearing.

The other parts of the swash-plate type compressor illustrated in FIGS. 2, 3 and 4 are similar in construction to the structure of FIG. 1, of which description is therefore omitted.

In the above-described swash-plate type compressor, lubrication of various sliding portions is carried out in the following manner: Rotation of the swash plate 12, which takes place in unison with rotation of the drive shaft 11, causes the pistons 24 to make reciprocal motions within the respective cylinder bores 3, 4, in a similar manner to the conventional arrangement. On this occasion, part of the lubricating oil within the cylinder bores 3, 4 is leaked as blow-bye gas into the swash plate chamber 25 through the clearances between the cylinder bores 3, 4 and the pistons 24, with the result that the pressure in the chamber 25 becomes higher than that in the suction chambers 31, 32 within the cylinder heads 7, 8. Due to a pressure differential between the swash plate chamber 25 and the suction chambers 31, 32 thus produced, the lubricating oil stored in a liquid state in the oil pan 26 is forced to travel in the lubricating oil channels 37, 38 to reach their openings 41, 42 in the through bores 15, 16 and hence is guided through the clearances between the through bores 13, 14 and the drive shaft 11 to reach the radial bearings 17, 18. After lubricating the bearings 17, 18, it is introduced into the suction chambers 31, 32 via gaps between the valve plates 9, 10 and the drive shaft 11. On the other hand, a pressure drop occurs in the vicinity of the inner end faces 13*a*, 14*a* of the boss portions 13, 14 disposed in contact with the thrust bearings 19, 20, due to centrifugal force produced by the rotation of the same bearings so that the lubricating oil staying in the through bores 15, 16 is guided to the bearings 19, 20 to lubricate same. Further, part of the lubricating oil which adheres to the bearings 19, 20 is dispersed by the rotation of the same bearings to lubricate the sliding portions between the swash plate 12 and the pistons 24. On this occasion, since the open ends 41, 42 of the lubricating oil channels 37, 38 are located in the through bores 15, 16 so as to satisfy the ratio of the distance a to the distance b of 1 to 2 at maximum in the case of the radial bearings 17, 18 being formed of plain bearings as previously described, the radial bearings 17, 18 and the thrust bearings 19, 20 are both supplied with respective proper amounts of lubricating oil. Also in the case of the radial bearings 17, 18 being formed of needle bearings, due to the locations of the open ends 41, 42 satisfying the distance ratio of approximately 1 to 1.

Incidentally, in addition to the above lubrication according to the invention, the lubricating oil in the lower part of the swash plate chamber 25 is splashed upwardly by the swash plate 12 being rotated into a mist to lubricate the thrust bearings 19, 20 and the sliding portions between the swash plate 12 and the pistons 24, in a similar manner to the conventional compressor.

In the illustrated embodiments, the partition walls 27, 28 provided between the swash plate chamber 25 and the oil pan 26 serves to prevent surging of the lubricating oil in the oil pan 26. These partition walls 27, 28 may be omitted if necessary.

The radial bearings 17, 18 may not be limited to plain bearings or needle bearings as illustrated in the drawings, but other types of bearings may be used with equivalent effects which include roller bearings or ball bearings. Further, the inner peripheral walls of the boss portions of the cylinder blocks per se may so configurated as to serve as radial bearings.

As set forth above, according to the present invention, the liquid lubricating oil in the oil pan is allowed to be fed to the radial bearings and thrust bearings supporting the drive shaft, through the lubricating oil channels to lubricate same, while maintained in a liquid state all the time. Further, the lubricating oil fed to the thrust bearings is dispersed due to the rotation of thrust bearings to lubricate the sliding portions between the swash plate and the pistons. Therefore, lubrication of various sliding portions in the compressor can be carried out with certainty, irrespective of the operating state of the compressor, thus making it possible to overcome the drawbacks in the conventional pressure differential type lubrication system using a misty lubricating oil.

While a preferred embodiment of the invention has been described, variations thereto will occur to those skilled in the art within the scope of the present inventive concepts which are delineated by the following claims.

What is claimed is:

1. In a swash-plate type compressor having a pair of cylinder blocks combined together in axial alignment and having axes thereof disposed horizontally, each including a plurality of cylinder bores and a boss portion formed therein with a through bore extending axially thereof, said boss portions of said cylinder blocks having inner end faces disposed opposite and spaced from each other; a plurality of pistons slidably received within said clyinder bores; a drive shaft rotatably inserted in said axial through bores; a swash plate secured on said drive shaft in slidable engagement with said pistons; a pair of valve plates arranged at opposite ends of said combined cylinder blocks; a pair of cylinder heads secured to the opposite ends of said combined cylinder blocks, said cylinder heads having suction chambers; said valve plates each having a through bore directly communicating an associated one of said axial through bores in said cylinder blocks with an associated one of said suction chambers; said boss portions of said cylinder blocks each having an outer end face disposed substantially in contact with an associated one of said valve plates; a pair of plain radial bearings mounted within said axial through bores and supporting said drive shaft radially thereof; a pair of thrust bearings interposed between said boss portions and said swash plate and supporting said swash plate axially thereof; adjacent lower ones of said cylinder bores defining therebetween a swash plate chamber and an oil reservoir located beneath said swash plate chamber and communicating therewith, said swash plate chamber communicating with all said cylinder bores;

the improvement which comprises:

a pair of wall portions, each having a substantial thickness and extending from said boss portions to bottom portions of said cylinder blocks, said wall portions defining therebetween said swash plate chamber and said oil reservoir; and a pair of lubricating oil channels formed within said wall portions, said lubricating oil channels each having one end opening in said oil reservoir and the other end opening in a peripheral inner wall of an associated one of said axial through bores at such a predetermined axial location between an associated one of said radial bearings and an associated one of said thrust bearings as permits supply of suitable amounts of lubricating oil from said other end of each of said lubricating oil channels to both said associated radial bearing and said associated thrust bearing, said other ends of said lubricating oil channels each having an opening having a diameter larger than that of the remaining portion thereof;

whereby rotation of said swash plate causes lubricant oil in said oil reservoir to be guided through said lubricating oil channels such that part of said lubricant oil is fed in a liquid state to said thrust bearings through gaps between said drive shaft and said axial through bores in said cylinder blocks due to centrifugal force produced by rotation of said thrust bearings, and such that the other part of said lubricant oil is fed in a liquid state to said radial bearings due to a pressure difference between said oil reservoir and said suction chambers, which pressure difference is caused by reciprocating motions of said pistons within respective cylinder bores thereof;

said other ends of said lubricating oil channels being located at locations where the distance ratio of a to b is 1 to 2 at maximum, wherein a represents the distance between the diametrical center of said other end of said lubricating oil channel and said outer end face of an associated one of said boss portions of said cylinder blocks, and b represents the distance between the diametrical center of said other end of said lubricating oil channel and said inner end face of said associated boss portion.

2. The swash-plate type compressor as claimed in claim 1, wherein said lubricating oil channels each have said other end located at a predetermined axial location dependent upon a pressure in an associated one of said suction chambers and a pressure in said swash plate chamber at a location in the vicinity of an associated inner end face of said boss portions of said cylinder blocks, the pressures prevailing during operation of the compressor, as well as dependent upon the ratio in flow resistance between a portion of an associated through bore extending from said other end of said lubricating oil channel to an associated outer end face of said boss portions of said cylinder blocks, and another portion of said associated through bore extending from said other end of said lubricating oil channel to an associated inner end face of said boss portions, said predetermined axial location being as permits feeding of lubricating oil to an associated radial bearing at a rate at least about 1.5 times as large as to an associated thrust bearing.

3. The swash-plate type compressor as claimed in claim 1, wherein the clearance of each of said gaps between said drive shaft and said axial through bores is set at a value of 0.02–0.04 mm.

4. In a swash-plate type compressor having a pair of cylinder blocks combined together in axial alignment and having axes thereof disposed horizontally, each including a plurality of cylinder bores and a boss portion formed therein with a through bore extending axially thereof, said boss portions of said cylinder blocks having inner end faces disposed opposite and spaced from each other; a plurality of pistons slidably received within said clyinder bores; a drive shaft rotatably inserted in said axial through bores; a swash plate secured on said drive shaft in slidable engagement with said pistons; a pair of valve plates arranged at opposite ends of said combined cylinder blocks; a pair of cylinder heads secured to the opposite ends of said combined cylinder blocks, said cylinder heads having suction chambers; said valve plates each having a through bore directly communicating an associated one of said axial through bores in said cylinder blocks with an associated one of said suction chambers; said boss portions of said cylinder blocks each having an outer end face disposed substantially in contact with an associated one of said valve plates; a pair of radial needle bearings mounted within said axial through bores and supporting said drive shaft radially thereof; a pair of thrust bearings interposed between said boss portions and said swash plate and supporting said swash plate axially thereof;